United States Patent [19]

Arft

[11] Patent Number: 4,928,331

[45] Date of Patent: May 29, 1990

[54] ADJUSTABLE SEAT PITCH SOFA SLEEPER MECHANISM

[75] Inventor: Dennis E. Arft, Joplin, Mo.

[73] Assignee: Leggett & Platt, Incorporated, Carthage, Mo.

[21] Appl. No.: 327,017

[22] Filed: Mar. 22, 1989

[51] Int. Cl.[5] ..... A47C 17/22

[52] U.S. Cl. ..... 5/13; 5/29

[58] Field of Search ..... 5/13, 29, 31, 6, 34, 5/51 G, 51 J, 51 L

[56] References Cited

U.S. PATENT DOCUMENTS

| | | | |
|---|---|---|---|
| 2,634,428 | 4/1953 | Fox | 5/13 |
| 2,748,398 | 6/1956 | Thomas | 5/13 |
| 3,694,828 | 10/1972 | Miko et al. | 5/13 |
| 4,104,745 | 8/1978 | Pacitti | 5/29 X |
| 4,439,878 | 4/1984 | Stevens | 5/13 X |
| 4,571,755 | 2/1986 | Stevens . | |

*Primary Examiner*—Michael F. Trettel

*Attorney, Agent, or Firm*—Wood, Herron & Evans

[57] ABSTRACT

A foldable sofa sleeper mechanism having pivotally interconnected head, body, intermediate and foot sections movable between a folded position in which the mechanism is contained within a storage enclosure of a sofa frame, and an extended unfolded position in which the bed frame extends in a planar attitude away from the sofa frame, and seat pitch adjustment means including an adjustable stop for varying the angle of pitch of the foot section, and thus of the seat, when the sofa sleeper mechanism is folded within the storage enclosure.

12 Claims, 3 Drawing Sheets

ADJUSTABLE SEAT PITCH SOFA SLEEPER MECHANISM

This invention relates to a sofa sleeper and, more particularly, to a sofa sleeper of the type which includes a foldable bed having head, body, intermediate, and foot sections which are foldable and which may be collapsed and hidden in the bottom of the sofa frame when the sofa sleeper is used as a seating surface.

Sofa sleeper mechanisms generally comprise a four-section foldable bed frame including pivotally interconnected head, body, intermediate, and foot sections which are adapted to be moved between a fully folded or retracted position contained within a box-like sofa frame, and an extended position wherein the sections extend out and over the front rail of the sofa frame to form an extended flat bed. The head, body, intermediate and foot sections of the bed frame each include a pair of opposed side frame members, usually in the form of angles or tubes, which are pivotally connected at their ends so that the sections are foldable or collapsible upon one another. The side frame members support a link or cloth fabric over which a mattress is placed. The bed frame is supported when in the extended bed position by linkage mechanisms at the head end and by a plurality of foldable legs at the center and foot end of the frame.

Typically, sofa sleepers are sold with either a relatively thin foam mattress or a thicker innerspring mattress. A relatively thin foam mattress requires less space and compresses much more easily than a heavier or thicker innerspring mattress when the mattress is folded up within the sofa sleeper mechanism and inserted into the interior of the sofa sleeper frame. Because of this differential in space requirements, a folded mechanism containing the heavier or thicker mattress has a different angle or so-called "seat pitch" on the top seating surface of the folded mechanism than the same mechanism when folded while containing a lighter and thinner mattress.

It has therefore been an objective of this invention to provide an improved sofa sleeper mechanism which accommodates mattresses of differing thickness with equal seat pitch. Otherwise expressed, it has been an objective of this invention to provide a sofa sleeper mechanism which, when folded, may accommodate either a thin, as for example, four-inch height, or a thick, as for example, six-inch height, mattress and still achieve the same or equal "seat pitch", i.e., the same angle seating surface in the folded mechanism.

To accomplish this objective, the improved sofa sleeper mechanism of this invention includes an adjustable stop for varying the angle or pitch of the seat section of the bed frame when the mattress-containing sofa sleeper mechanism is folded into the sofa sleeper frame.

SUMMARY OF THE INVENTION

According to the practice of this invention, a foldable sofa sleeper mechanism is mounted upon a sofa frame in such a manner that it may be stored within a storage enclosure of the sofa frame. The mechanism includes a bed frame having pivotally interconnected head, body, intermediate and foot sections, as well as a mattress supporting fabric extended between opposed side rails of the sections. The bed frame is supported from the sofa sleeper frame by a linkage mechanism including front and rear support links and a pair of center legs connected to a center leg actuating arm operable to retract the center legs beneath the body section of the frame when the mechanism is folded into the sofa frame and to extend the center legs into an unfolded vertical orientation beneath the center section of the bed frame when the bed frame is extended into a horizontal flat orientation. The linkage mechanism includes an adjustable stop for varying the angle of pitch of the foot section of the bed frame when the sofa sleeper mechanism is in a folded position within the storage enclosure of the sofa frame. When a thin mattress is to be contained within the mechanism, the stop is set in a position in which the foot section of the folded bed frame is located in a horizontal plane. When a thick mattress is to be contained within the mechanism, the stop is set in a position in which, in the absence of the mattress, the foot section is angled downwardly and rearwardly from the front. But, with the thick mattress contained in the mechanism, this angled position enables the folded mechanism to accommodate the thick mattress and be forced by that thick mattress to locate the foot section—now the seating surface—into a horizontal attitude or position. In other words, this stop mechanism enables the seat pitch of the folded mechanism to be adjusted so that when a thick mattress is contained in the folded mechanism, that thick mattress takes advantage of the tolerances in the mechanism to force the foot section of the folded mechanism into a horizontal plane. Thus, the same seat pitch or angle can be achieved by the mechanism using either a thin or thick mattress by simply adjusting the position of the seat pitch adjustable stop.

This same seat pitch adjustable stop has another advantage when applied to a mechanism which is to be used to accommodate mattresses of the same thickness. Some sofa sleeper manufacturers prefer mechanisms which, when the mattress is contained in the mechanism, have an angled seating surface, and other manufacturers prefer mechanisms which have a flat seating surface. The mechanism of this invention, with its seat pitch adjustable stop, enables the same mechanism to satisfy both preferences even though both manufacturers may be selling the mechanism in sofa sleepers containing the same height mattresses.

These and other objects and advantages of this invention will be more readily apparent from the following description of the drawings in which.

Figure 2:
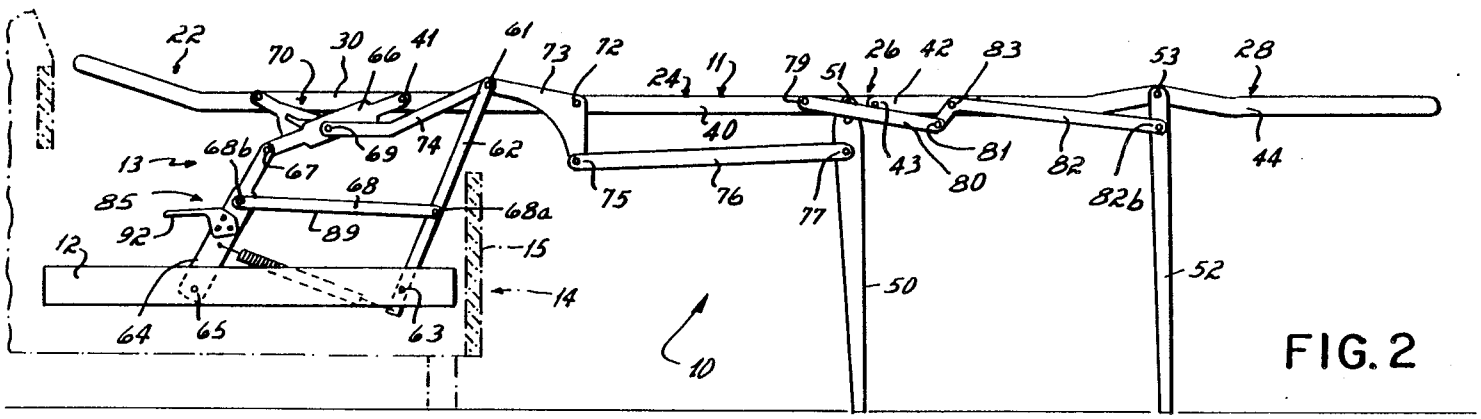
FIG. 2 is a side elevational view of the mechanism of FIG. 1.
Figure 4:
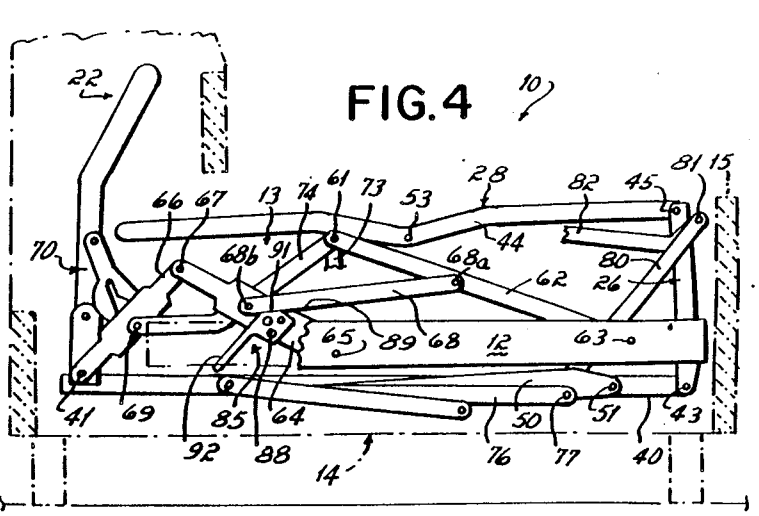
FIG. 4 is a side elevational view of the mechanism of FIG. 1 in the folded condition of the mechanism, but with the seat pitch adjustment mechanism in a second or different position from that illustrated in FIG. 3.
Figure 3:
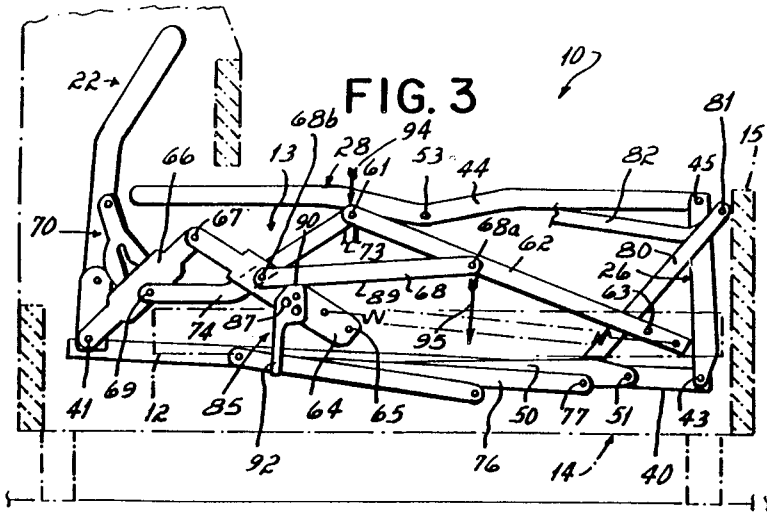
FIG. 3 is a side elevational view of the mechanism of FIG. 1, but in a folded condition of the mechanism, the seat pitch adjustment mechanism being in a first position of adjustment.

Referring now to the drawings, it will be noted that the sofa sleeper mechanism 10 is supported from a pair of mounting plates 12 which are fixedly secured to an upholstered sofa frame, indicated generally by the numeral 14 (FIGS. 2–4). The upholstered sofa frame conventionally has a backrest cushion (not shown), a pair of side rails (not shown) and a fixed front rail 15 which define a generally rectangular storage enclosure for the folded mechanism 10 (FIGS. 3 and 4). The sofa frame 14 per se does not form any part of the invention of this application and may comprise any standard upholstered frame.

The foldable sofa sleeper mechanism 10 comprises a bed frame 11 and a linkage mechanism 13 for supporting that frame 11 from the mounting plates 12. The bed frame 11 comprises a rear head section 22, a long body section 24 pivotally connected at one end to the head section 22, a short intermediate section 26 pivotally connected at one end to the other end of the body section 24, and a foot section 28 pivotally connected to the other end of the short intermediate section 26.

The head section 22 comprises symmetrically disposed left and right side members 30. In the illustrated embodiment, these side members are tubular in configuration and are interconnected by a cross member 36 which comprises a transverse tubular section of the side members 30.

The body section 24, the short intermediate section 26, and the foot section 28 each comprises symmetrically disposed left and right side members 40, 42 and 44, respectively. The body section side frame members 40, the intermediate section side members 42, and the foot section side frame members 44 are angular shaped in configuration. A tubular transverse cross member 46 connects the forward ends of the foot section side members 44. In the preferred embodiment, the foot section side members 44 and the transverse cross member 46 are separate elements, but they could as well be bent from a single unitary tube.

The interconnected bed frame sections 22, 24, 26 and 28 are supported in their extended position by a pair of foldable center support legs 50 pivotally connected to the forward ends of the body section side members 40 by rivets 51. A generally U-shaped foot section support leg 52 is pivotally connected at its upper ends by rivets 53 to the foot section side members 44. A tubular cross member 54 interconnects the center legs 50 and is riveted thereto to provide the legs 50 with lateral stability.

A cross brace 56 extends between the opposite side members 40 of the body section 24. Similar cross braces 57, 58 extend between the side members 30 and 42 of the head and intermediate sections 22, 26, respectively, of the mechanism. The opposite ends of each of these cross braces 56, 57, 58 is fixedly attached to the side members of the body section and intermediate section of the mechanism, respectively, so as to provide lateral stability to the bed frame.

Stretched between the side frame members of the head, body, intermediate and foot sections of the frame is a fabric 60 for supporting a mattress atop the mechanism. The fabric 60 may be a wire link fabric or a cloth fabric or any other conventional mattress supporting flexible fabric material. Such fabric materials are conventional and per se form no part of the invention of this application.

The interconnected sections 22, 24, 26 and 28 together form the rectangular bed frame 11 with curved corners when the mechanism 10 is fully pulled out. As may be seen in FIGS. 1 and 2, the sections lie in coplanar relationship, i.e., they all lie on the same horizontal plane and provide a resilient planar surface for supporting a mattress (not shown).

The foldable frames on both sides of the bed are similar and are symmetrically disposed. Since the means which connect the longitudinal portions of the bed frame on the right and left facing sides of the bed are similar and symmetrically disposed, only the connections on one side have been illustrated and will be described herein. However, in some instances, it may be necessary to refer to the opposite side to find reference numerals. The side of the frame shown in FIGS. 2–4 is the left facing side of the bed which is the side on the left side of a person standing in front of the foot end of the bed and looking toward the head end of the bed.

The side members 30 of the head section 22 are pivotally connected to the rearward end of the side members 40 of the body section 24 by a rear rivet 41. This rivet connection enables the head section to pivot relative to the side members 40 of the body section.

The forward end of the side members 40 of the body section are pivotally connected to the intermediate frame section members 42 by a pivot 43. At the forward end, the intermediate frame section members 42 are pivotally connected by a rivet 45 to the rearward end of the side members 44 of the foot section 28 of the mechanism.

Figures 1, 1A:
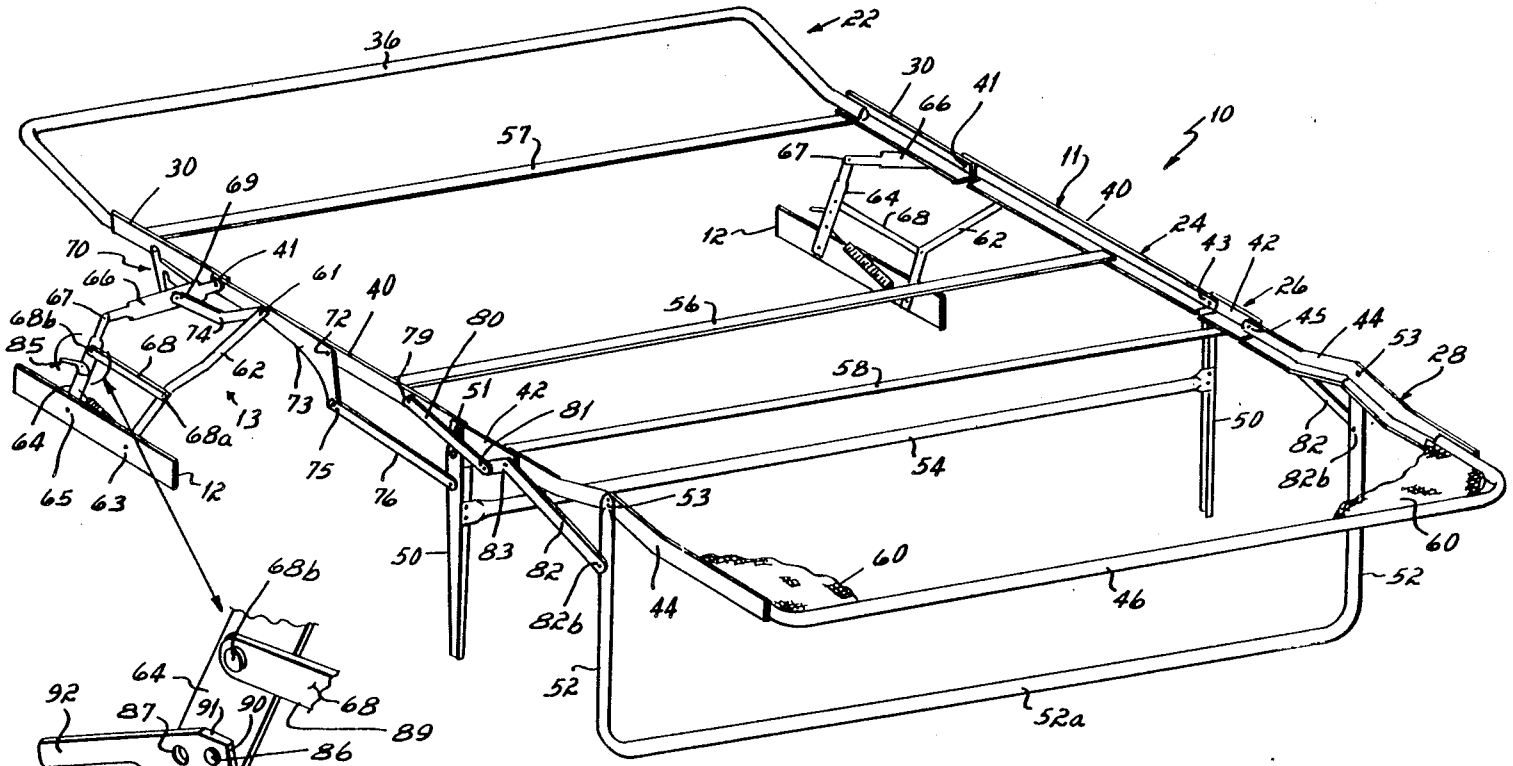
FIG. 1 is a perspective view of an unfolded sofa sleeper mechanism incorporating the invention of this application.
FIG. 1A is an enlarged perspective view of the encircled portion of FIG. 1.

Referring now to FIGS. 1 and 2, it will be seen that the sofa sleeper mechanism 10 is supported upon the sofa frame by a series of links supported from the mounting plate 12. This mounting plate is secured to the sofa frame 14 by conventional screws or fasteners (not shown). Pivotally mounted upon this mounting plate is a pilot arm 62, the lower end of which is pivotally connected to the mounting plate by a rivet 63 and the upper end of which is pivotally connected to an actuating link 74 by a rivet 61. A pair of interconnected lower and upper rear support links 64, 66, respectively, interconnect the head end of the side members 40 of the body supporting section 24 of the frame to the mounting plate 12. The lowermost one 64 of these links is pivotally attached to the mounting plate 12 by a rivet 65, and the upper end of the uppermost one 66 of these supporting links is pivotally secured to the rear of the side member of the body supporting section 24 of the frame by the rivet 41. The two links 64, 66 are interconnected at their upper and lower ends, respectively, by a rivet 67. The pilot arm 62 and the lower rear support link 64 are interconnected by a control link 68 which is pivotally connected to each link by a rivet **68*a* and 68*b***, respectively.

A conventional TV lock mechanism indicated generally by the numeral 70 interconnects the upper rear support link 66 with the side members of the head section of the frame. This conventional mechanism enables the head section of the frame to be pivoted and locked in an upwardly sloping position relative to the side members of the body section of the frame so as to facilitate TV viewing or reclining on the unfolded bed with the head end of the bed tilted upwardly. Since this mechanism 70 is conventional and forms no part of the invention of this application, it has not been described in detail herein.

The actuating link 74 is pivotally connected to the upper rear supporting link 66 by a rivet 69 located medially between the rivets 67 and 41. It is also connected not only to the upper end of the pilot arm 62 by the rivet 61, but to a bell crank 73 by this same rivet 61.

The bell crank 73 extends forwardly from its pivotal connection 61 with the upper end of the pilot arm 62 and the actuating link 74 to a pivotal connection via a rivet 72 with the side member 40 of the body section of the bed frame 11 and a rivet connector 75 with a center leg actuating arm 76. At its forward end, the actuating arm 76 is pivotally connected to the center leg 50 via a rivet 77. As is conventional in such foldable sofa sleeper mechanisms, the actuating link 74 cooperates with the actuating arm 76 to effect inward folding of the leg 50 about its pivotal connection 51 against the side member 40 of the body section of the frame when the mechanism is collapsed during folding into the sofa frame 14.

In order to actuate the front leg so as to cause it to move upwardly to position the transverse leg tube **52*a* in juxtaposition to the transverse tube 46 of the foot section of the frame, a pair of links, a compression lock link 80, and a leg lock link 82, interconnect the upper end of the front leg 52 with the side member 40 of the body section of the frame and with the side member 42** of the intermediate section of the frame, respectively.

The compression lock link 80 is pivotally connected to the side member 40 by a rivet 79 and is pivotally connected to the rearward end of the leg lock link 82 via a rivet 81. The leg lock link 82 is pivotally connected via a rivet 83 to the side members 42 of the intermediate section 26 of the frame and is connected at its forward end to the leg 52 via a rivet **82*b***. This connection of the front leg to the side members of the frame is also conventional and is operative to collapse the front leg of the frame into juxtaposition with the foot section of the mechanism when the mechanism is collapsed preparatory to being folded into the sofa sleeper frame.

MECHANISM OPERATION

Folding of the mechanism into the cavity of the sofa frame 14 from the flat bed position illustrated in FIGS. 1 and 2 to the collapsed position of the sofa mechanism within the storage enclosure of the sofa sleeper frame 14 illustrated in FIGS. 3 and 4 is accomplished in the conventional manner and has therefore not been illustrated and described in detail herein. It is illustrated and described in a very similar sofa sleeper mechanism in U.S. Pat. No. 4,571,755 assigned to the assignee of this application. It is also illustrated and described in numerous other sofa sleeper patents having similar sofa sleeper mechanism linkages for collapsing and folding a mattress supported by the mechanism into and locating that mechanism and mattress within the storage cavity of a sofa sleeper.

Basically, the mechanism is folded from the flat bed position illustrated in FIGS. 1 and 2 into the collapsed sofa position illustrated in FIG. 4 by first lifting the front tubular cross member 46 of the foot section of the mechanism until that foot section is located in a vertical plane. As a consequence of this movement, the front leg 52 is caused by the leg lock link 82 and the compression lock link 80 to be folded into juxtaposition with the side members of the foot section 28 of the mechanism.

Continued pushing against the now vertically oriented leg cross tube **52*a* and foot section cross member 46 causes the mechanism to pivot about the pivot point or rivet 43 connecting the intermediate frame section 26 to the body section 24, thereby lifting the intermediate frame section 26 into a vertical position and simultaneously positioning the foot section 28 of the mechanism in a horizontal plane overlying the body section 24 by virtue of being pivoted about the pivot 45 connecting the foot section 28 to the intermediate section 26**.

Continued folding movement of the mechanism is then effected by lifting the cross tie member 58 upwardly so as to lift what is now the front of the partially folded mechanism, including the center leg 50, upwardly. This upward movement of the folded foot and intermediate sections of the frame causes the actuating link 74, bell crank 73 and actuating arm 76 to collapse the center legs 50 beneath the body section 24 of the frame. Continued lifting of the front section of the folded leg and intermediate sections of the frame causes the rear end of the body section of the mechanism to be lowered and moved rearwardly. Simultaneously, the head section 22 is moved into an inclined position with respect to the body section 24 preparatory to the head section of the frame being moved up into the cavity in the backrest section of the sofa frame. On further movement of the folded frame, the head section continues to rotate until the head section is generally perpendicular to the body section and the body section is located in a horizontal plane internally of the enclosure of the sofa frame, as illustrated in FIGS. 3 and 4.

The mechanism 10 described hereinabove and the manner in which it is folded into the enclosure of the sofa frame 14 and unfolded therefrom into the flat bed position illustrated in FIGS. 1 and 2 is conventional and per se forms no part of the invention of this application. In fact, other conventional mechanisms could as well be utilized in the practice of this invention.

SEAT PITCH CONTROL MECHANISM

With reference now to FIGS. 1, 1A and 2, it will be seen that on each side of the linkage mechanism 13 there is pivotally mounted on the lower support link 64 an adjustable stop 85. This stop is pivotally secured to the lower support link 64 by a rivet 86. A spring washer (not shown) is preferably located between the head of the rivet 86 and the inside surface of the support link 64 so as to bias the stop 85 toward the outside surface of the link 64.

In addition to the hole through which the rivet 86 passes, the stop 85 includes two additional holes 87, 88. One or the other of these two holes is selectively engaged with a detent 84 pressed from the lower support link 64. When one of these holes 87 is engaged with the detent 84, a stop surface 90 of the stop 85 is engageable with the underside surface 89 of the control link 68. When the other hole 88 is engaged with the detent 84, another stop surface 91 of the stop is engageable with this surface 89 on the underside of the control link 68. By moving a handle 92 of the stop 85, the stop may be rotated so as to align either one of the holes 87, 88 with the detent. The handle thus facilitates rotational movement of the stop and positioning of the stop with the appropriate one of the two stop surfaces 90, 91 in a position to be engaged by the underside 89 of the control link 68.

With reference now to FIG. 3, it will be seen that with the handle 92 of the stop 85 pointing downwardly or moved into a downwardly extending vertical orientation, the hole 87 is aligned with the detent on arm 64 to position the stop surface to be engaged with the underside 89 of the control link 68. By pivoting or rotating the stop 85 in a clockwise direction from the position shown in FIG. 3, the detent 84 of the lower support link 64 may be aligned with the other hole 88 of the stop so as to position the other stop surface 91 of the stop in a position to be engaged by the underside 89 of the control link 68.

In the final stages of the folding of the sofa sleeper mechanism into the interior of the sofa frame enclosure, the two pivots 61 and 68*a* of the pilot arm 62 move downwardly as indicated by the arrows 94 and 95 in FIGS. 3 and 4. This downward movement of these pivots continues until the control link 68 engages one of the stop surfaces 90 or 91 of the stop 85. In the position of FIG. 3, the stop surface 90 of the stop is engaged by the underside 89 of the control link 68 so as to stop or terminate the insertion of the folded mechanism into the frame with the foot section 28 of the bed frame in a generally horizontal attitude. On the other hand, if the stop surface 91 of the stop 85 is in a position to be engaged with the underside 89 of the control link 68, then the rear end of the mechanism drops lower into the frame, and in so doing, angles the foot section 28 of the bed frame downwardly and inwardly to a greater extent than when the other stop surface 90 is engaged by the same control link. As a result, when the stop surface 90 is engaged with the control link 68 of the folded mechanism, the foot section 28 of the bed frame is located in a horizontal plane, and when the other stop surface 91 is engaged with the underside of the control link 68, as illustrated in FIG. 4, the foot section 28 is angled slightly downwardly and rearwardly in the folded mechanism.

It will be appreciated that the provision of the stop 85 on the lower support arm 64 in a position to be engaged with the control link 68 enables the seat pitch to be varied or adjusted, and thereby the angle of pitch of the foot section 28 of the folded bed frame to be varied. This enables a manufacturer to ship different thicknesses of mattresses to retailers within the same sofa sleeper mechanism with the same or differing pitches of the collapsed sofa sleeper.

Figure 5:
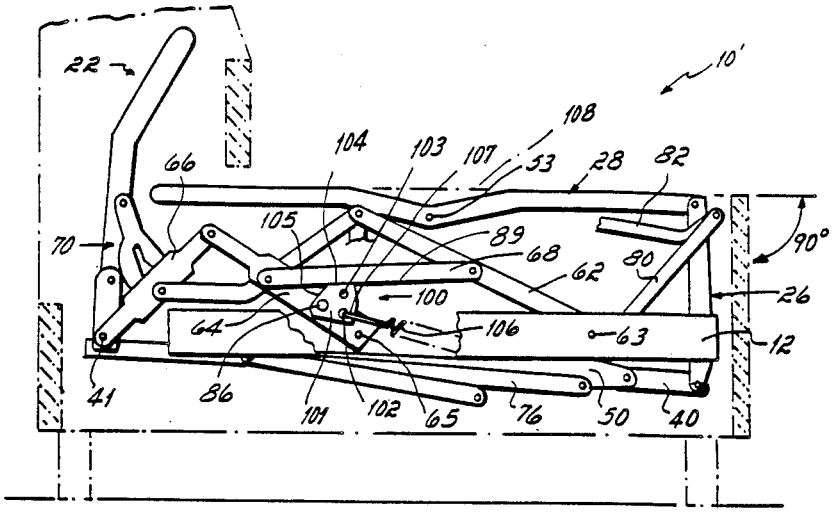
FIG. 5 is a side elevational view, similar to FIG. 3, of the folded mechanism, but with the mechanism incorporating a second embodiment of the seat pitch adjustment mechanism.
Figure 6:
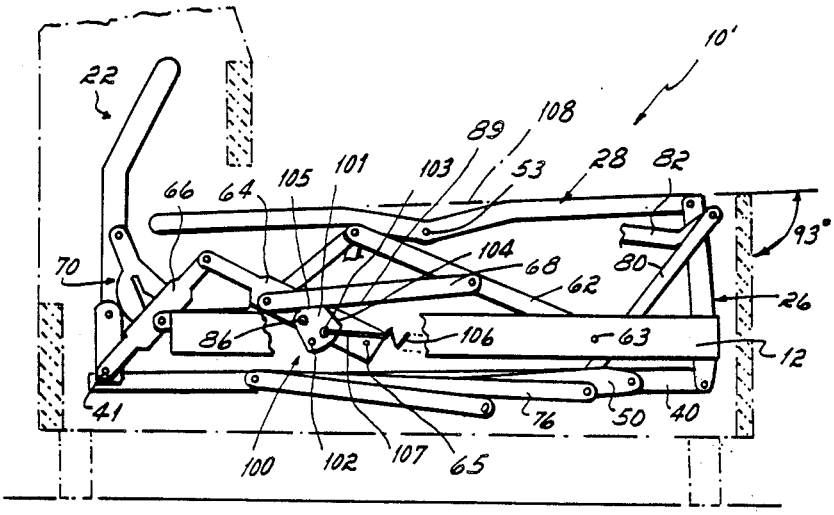
FIG. 6 is a view similar to FIG. 5, but with the seat pitch adjustment mechanism of FIG. 5 in a second position of adjustment.

With reference to FIGS. 5 and 6, there is illustrated a second embodiment of the invention of this application. In this embodiment, the sofa sleeper mechanism 10' is identical to the mechanism 10 of FIGS. 1–4, except that this embodiment utilizes a different adjustable stop from the embodiment of FIGS. 1–4. Accordingly, those elements or links of the sofa sleeper mechanism 10' of FIGS. 5 and 6 which are identical to the corresponding elements or links of the embodiment of FIGS. 1–4 have been given identical numerical designations.

The sofa sleeper mechanism 10' of FIGS. 5 and 6 differs from the sofa sleeper mechanism 10 of FIGS. 1–4 in that it includes adjustable stops 100 which differ from the adjustable stops 85 of the embodiment of FIGS. 1–4. Each adjustable stop 100 of this second embodiment includes a stop plate 101 which is pivotally mounted upon the support link 64 by a rivet 86. The adjustable stop plate 101 has two holes 102, 103 formed therein and equidistantly spaced from the hole through which the rivet 86 passes. These two holes 102, 103 are alignable with a hole formed in the lower support link 64. The alignable hole in the lower support link 64 is spaced the same distance as the holes 102, 103 from the hole in the lower support link through which the rivet 86 passes. When hole 102 of these holes 102, 103 is aligned with the alignable hole of the lower support link 64, one stop surface 104 of the adjustable stop plate 101 is engageable with the control link 68 (see FIG. 5), and when the other hole 103 is aligned with the mating hole of the lower support link 64, a second stop surface 105 of the stop plate 101 is engageable with the control link 68 (see FIG. 6).

In order to hold the adjustable stop plate 101 in either one of its two positions of adjustment, a hook-shaped rear end 107 of a lift assist spring 106 is inserted through one of the holes 102 or 103 and the alignable hole in the support link 64. Thus, the rear hook-shaped end 107 of the spring 106 serves to lock or secure the stop plate 101 in either one of its two positions of adjustment on the lower support link 64.

With reference to FIG. 5, it will be seen that when the stop plate 101 is in a position of adjustment in which the rear end 107 of the spring 106 extends through the hole 102 and the alignable hole in the lower support link 64, the stop surface 104 of the stop plate 101 is engageable with the underside surface 89 of the control link 68. When the stop surface 104 of the stop plate 101 is engaged by the bottom surface of the control link 68, it terminates or stops any further collapsing movement of the folded sofa sleeper mechanism 10' into the sofa sleeper frame. In this fully folded or collapsed position of the sofa sleeper frame, the foot section 28 of the frame is located in a horizontal plane, and thus defines a zero-pitch seating surface 108 in the folded sofa sleeper mechanism. On the other hand, if the inner end 107 of the spring 106 is inserted through the hole 103 of the stop plate 101 and the alignable hole of the lower support link 64, the second stop surface 105 of the stop plate 101 is engageable with the underside surface 89 of the control link 68. This is the position illustrated in FIG. 6. In this second position (FIG. 6) of the stop plate 101, the rear of the folded sofa sleeper mechanism drops further into the frame before the underside surface 89 of the control link 68 engages the stop surface 105 of the stop plate 101. Consequently, the seating surface 108 of the folded sofa sleeper mechanism is angled slightly downwardly and rearwardly from the front of the sofa sleeper so as to impart a slightly angled pitch to the seating surface 108 of the folded sofa sleeper mechanism.

It will readily be appreciated that in lieu of using the end 107 of the spring 106 to lock or secure the adjustable stop plate 101 in either one of its two positions of adjustment, a bolt (not shown) could as well be selectively inserted through the holes 102 or 103 and the alignable hole of the lower support link to secure the stop plate 101 in either of its two positions of adjustment. Or, alternatively, a dial having multiple positions of adjustment could be used in lieu of the stop plate 101 with its two positions of adjustment. Or, as yet another alternative, a lifter plate similar to a large bushing could be dropped over a headed rivet to serve the same adjustable stop function relative to limiting the drop of the rear of the folded sofa sleeper mechanism into the sofa sleeper frame so as to vary the seat pitch of the folded mechanism.

Therefore, while I have described only a selected number of preferred embodiments of my invention persons skilled in this art will appreciate other changes and modifications which may be made without departing from the spirit of my invention. Therefore, I do not intend to be limited except by the scope of the following appended claims.

I claim:

1. A foldable sofa sleeper mechanism adapted to be mounted upon a sofa frame and stored within a storage enclosure of the sofa frame, said mechanism comprising a bed frame having pivotally interconnected head, body, intermediate and foot sections each having a pair of opposed side rails, a mattress supporting fabric extending between said sections and connected thereto, linkage mechanism for supporting said bed frame from the sofa frame, said linkage mechanism comprising a pair of center legs connected to a center actuating leg means operable to retract and extend said center legs, said sofa sleeper mechanism being movable between a folded position in which said bed frame and said linkage mechanism are folded and contained within said storage enclosure of said sofa frame and said center legs are retracted, and an extended position in which said bed frame extends forwardly from said sofa frame and said center legs extend downwardly from said bed frame, the improvement comprising seat pitch adjustment means comprising an adjustable stop for varying the angle of pitch of said foot section of said bed frame by limiting and thereby controlling the downward movement of the rear of said folded bed frame, including the rear of said foot section, when said sofa sleeper mechanism is in a folded position within said storage enclosure said adjustable stop being movably mounted upon one element of said linkage mechanism and engageable with another element of said linkage mechanism, and said adjustable stop being pivotally mounted upon said one element for movement between either one of two stop positions, in both of which stop positions said stop is engageable with said other element.

2. The sofa sleeper mechanism of claim 1 in which said linkage mechanism comprises a base plate adapted to be fixedly secured to said sofa frame, a front pilot arm pivotally mounted upon said base plate, a rear support link pivotally mounted upon said base plate, and said adjustable stop being mounted upon said rear support link.

3. The sofa sleeper mechanism of claim 2 which further includes a control link pivotally connected to said front pilot arm and to said rear support link, said adjustable stop being engageable with said control link to limit movement of said linkage mechanism and attached bed frame when said sofa sleeper mechanism is folded into said storage enclosure.

4. The sofa sleeper mechanism of claim 3 in which said adjustable stop is pivotally mounted upon said rear support link.

5. The sofa sleeper mechanism of claim 4 wherein one of said adjustable stop and said rear support link has at least two recesses and the other has a detent adapted to be received within a selected one of said recesses for securing said stop in an adjusted position.

6. A foldable sofa sleeper mechanism adapted to be mounted upon a sofa frame and stored within a storage enclosure of the sofa frame, said mechanism comprising a bed frame having pivotally interconnected head, body, intermediate and foot sections each having a pair of opposed side rails, a mattress supporting fabric extending between said sections and connected thereto, a pair of substantially identical linkage mechanisms located on opposite sides of said sofa sleeper mechanism for supporting said bed frame from the sofa frame, each of said linkage mechanisms comprising a center leg connected to a center actuating leg means operable to retract and extend said center leg, said sofa sleeper mechanism being movable between a folded position in which said bed frame and said linkage mechanisms are folded and contained within said storage enclosure of said sofa frame and said center legs are retracted, and an extended unfolded position in which said bed frame extends forwardly from said sofa frame and said center legs extend downwardly from said bed frame, the improvement comprising seat pitch adjustment means on each of said pair of linkage mechanisms, said seat pitch adjustment means comprising an adjustable stop for varying the angle of pitch of said foot section by limiting and thereby controlling the downward movement of the rear of said folded bed frame, including the rear of said foot section of said bed frame when said sofa sleeper mechanism is in a folded position within said storage enclosure said adjustable stop being movably mounted upon one element of each of said linkage mechanisms and engageable with another element of each of said linkage mechanisms, and said adjustable stop being pivotally mounted upon said one element for movement between either one of two stop positions, in both of which stop positions said stop is engageable with said other element.

7. The sofa sleeper mechanism of claim 6 in which each of said linkage mechanisms comprises a base plate adapted to be fixedly secured to said sofa frame, a front pilot arm pivotally mounted upon said base plate, a rear support link pivotally mounted upon said base plate, and said adjustable stop being mounted upon said rear support link.

8. The sofa sleeper mechanism of claim 7 in which each of said linkage mechanisms further includes a control link pivotally connected to said front pilot arm and to said rear support link, said adjustable stop being engageable with said control link to limit movement of said linkage mechanism and attached bed frame when said sofa sleeper mechanism is folded into said storage enclosure.

9. The sofa sleeper mechanism of claim 8 in which said adjustable stop is pivotally mounted upon said rear support link.

10. The sofa sleeper mechanism of claim 9 wherein one of said adjustable stop and said rear support link has at least two recesses and the other has a detent adapted to be received within a selected one of said recesses for securing said stop in an adjusted position.

11. A foldable sofa sleeper mechanism adapted to be mounted upon a sofa frame and stored within a storage enclosure of the sofa frame, said mechanism comprising a bed frame having pivotally interconnected head, body, intermediate and foot sections each having a pair of opposed side rails, a mattress supporting fabric extending between said sections and connected thereto, linkage mechanism for supporting said bed frame from the sofa frame, said linkage mechanism comprising a base plate adapted to be fixedly secured to said sofa frame, a front pilot arm pivotally mounted upon said base plate, a rear support link pivotally mounted upon said base plate, and a pair of center legs connected to a center actuating leg means operable to retract and extend said center legs, said sofa sleeper mechanism being movable between a folded position in which said bed frame and said linkage mechanism are folded and contained within said storage enclosure of said sofa frame and said center legs are retracted, and an extended unfolded position in which said bed frame extends forwardly from said sofa frame and said center legs extend downwardly from said bed frame, and seat pitch adjustment means comprising a stop mounted upon said rear support link for varying the angle of pitch of said foot section of said bed frame by limiting and thereby controlling the downward movement of the rear of said folded bed frame, including the rear of said foot section, when said sofa sleeper mechanism is in a folded position within said storage enclosure.

12. The sofa sleeper mechanism of claim 11 which further includes a control link pivotally connected to said front pilot arm and to said rear support link, said stop being engageable with said control link to limit movement of said linkage mechanism and attached bed frame when said sofa sleeper mechanism is folded into said storage enclosure.

* * * * *

UNITED STATES PATENT AND TRADEMARK OFFICE

CERTIFICATE OF CORRECTION

PATENT NO. : 4,928,331

DATED : May 29, 1990

INVENTOR(S) : Dennis E. Arft

It is certified that error appears in the above-identified patent and that said Letters Patent is hereby corrected as shown below:

Col. 9, line 15, after "extended" and before "position" insert --unfolded--.

Signed and Sealed this

Fifteenth Day of September, 1992

*Attest:*

DOUGLAS B. COMER

*Attesting Officer*

*Acting Commissioner of Patents and Trademarks*